United States Patent [19]

Tsuji

[11] 4,232,994

[45] Nov. 11, 1980

[54] CENTRIFUGAL TURBOMACHINE

[75] Inventor: Koh Tsuji, Ebina, Japan

[73] Assignee: Hitachi, Ltd., Japan

[21] Appl. No.: 865,875

[22] Filed: Dec. 30, 1977

[30] Foreign Application Priority Data

Jan. 14, 1977 [JP] Japan ..... 52-2404

[51] Int. Cl.[3] ..... F01D 25/24

[52] U.S. Cl. ..... 415/127

[58] Field of Search ..... 415/126, 127, 54, 206

[56] References Cited

U.S. PATENT DOCUMENTS

| | | | |
|---|---|---|---|
| 1,745,253 | 1/1930 | Granberg | 415/126 |
| 2,212,113 | 8/1940 | Couch | 415/126 |
| 2,215,281 | 9/1940 | Von Haase | 415/127 |
| 2,363,191 | 11/1944 | Miller | 415/126 |
| 2,475,082 | 7/1949 | Davila | 415/127 |
| 2,772,636 | 12/1956 | Yates | 415/127 |
| 3,120,340 | 2/1964 | Strumpell | 415/127 |
| 3,227,902 | 1/1966 | Laing | 415/54 |
| 3,306,527 | 2/1967 | Cook | 415/127 |
| 3,496,704 | 2/1970 | Bandlow | 415/127 |
| 3,545,892 | 12/1970 | Zimmermann | 415/127 |
| 3,726,611 | 4/1973 | Astrom | 415/126 |
| 3,797,961 | 3/1974 | Brechbuhl | 415/126 |

FOREIGN PATENT DOCUMENTS

| | | | |
|---|---|---|---|
| 1327918 | 4/1963 | France | 415/127 |
| 884218 | 12/1961 | United Kingdom | 415/127 |
| 1456219 | 11/1976 | United Kingdom | 415/206 |

*Primary Examiner*—William L. Freeh

*Attorney, Agent, or Firm*—Craig & Antonelli

[57] ABSTRACT

A centrifugal turbomachine including a discharge port having a center line intersecting the axis of a rotatable shaft and the center line of the suction port so that the center line of the suction port is aligned with the axis of a rotatable shaft, and those center line axis and the center line of the discharge port lie within a plane, and an outer casing concentrical with the rotatable shaft and in the form of cylinder or consisting of discs serving as support means. The centrifugal turbomachine provides the following advantages in use:

(1) The machine can be installed by steplessly changing the discharge direction of fluid in a range of about 180° so that the discharge port can be directed horizontally rightwardly, vertically upwardly and horizontally leftwardly;

(2) The height of the rotatable shaft and the height of the suction port remain unchanged even if the discharge direction of fluid is varied; and (3) The height of the discharge port remains constant when the discharge port directed horizontally rightwardly is rearranged so that it will be directed horizontally leftwardly.

The centrifugal turbomachine disclosed is highly versatile in use, inexpensive and easy to effect standardization in production.

1 Claim, 9 Drawing Figures

CENTRIFUGAL TURBOMACHINE

BACKGROUND OF THE INVENTION

This invention relates to centrifugal turbomachines, and more particularly to centrifugal fans.

The prior spiral casing which constitutes a housing of a centrifugal turbomachine is not symmetrical with respect to a rotation axis of an impeller, so that various outer end portions of the spiral casing are spaced differently from the rotation axis. This makes it necessary to install the casing by varying the height of the rotation axis depending on whether the discharge port of the casing is directed horizontally or vertically upwardly. Therefore, the following problems have been encountered.

A. Problems in Manufacture (1) If belts of the same length for driving a centrifugal turbomachine are to be used, the position of an electric motor on the base must be changed.

(2) When the electric motor is displaced on the base in the manner described above, the belt used must have its length varied in the event that the motor is located near the fan. To cope with this situation, belts of different lengths must be kept in stock and, moreover, the position in which the electric motor is installed must generally be varied.

(3) In order to cope with these situations of Paragraphs (1) and (2), the base must be formed with several bores for bolting the machine in place, or bases for exclusive use with machines of different motor positions must be prepared.

(4) If it is desired to make it possible to freely select the location of the electric motor, there must be provided an expensive slide base.

(5) The height of the center line of the discharger port (which is generally aligned with the axis of the rotatable shaft) varies depending on the discharge direction.

(6) To maintain the height of the axis of the rotatable shaft, it is necessary to vary the length of the leg portion of the spiral casing depending on the discharge direction of fluid: This results in preparing various types of legs, which are comparatively expensive.

B. Problems in use (1) Even if fans are of the same type and size, the height of the axis of rotation varies depending on the discharge direction, and at the same time the height of the suction port is changed. Thus piping must be changed accordingly.

(2) The lateral sizes of the casing are variable depending on the discharge direction of fluid. This is inadvantageous in making effective use of the space available.

(3) The layout of the fan and the arrangement of piping must be planned each time the discharge direction is varied. This is a troublesome process.

The above description is done with respect to centrifugal fans of belt drive type. It should be noted, however, that with centrifugal fans of direct drive motor type the height of the axis of rotation and the height of the center line of the suction port are generally varied depending on the discharge direction of fluid.

With fans having a prior spiral casing, the center line of the discharge port is not flush with the axis of rotation. For this reason, the conventional centrifugal fans have the following disadvantages:

(1) The casing varies in size depending on the size of the impeller. For example, in case fluid is discharged in the horizontal direction, the height of the center line of the discharge port varies depending on the size of the impeller, even if the height of the axis of rotation is fixed. As a result, the dimensions of the impeller (that is, the aerodynamic performance of the fan) become interrelated with the arrangement of piping and pressure loss, making design very complex. The layout of piping is troublesome for users.

(2) In case the discharge direction of fluid is changed from the rightward horizontal direction into the leftward horizontal direction, the casing will have to be rotated through 180° and at the same time the height of the center line of the discharge port is varied. To maintain the height of the center line of the discharge port, it is required to produce casings and impellers exclusively for use in discharging the fluid in the horizontal right direction and in the horizontal left direction.

(3) Since the center line of the discharge port is offset from the axis of rotation, the discharge duct is generally bulky, thereby increasing a dead space which hampers effective utilization of the space of a room.

SUMMARY OF THE INVENTION

This invention has as its object the provision of a centrifugal turbomachine which eliminates the aforementioned disadvantages of the prior art centrifugal turbomachines.

According to the present invention, the aforementioned object is accomplished by arranging the suction port of the casing in such a manner that the center line of the suction port thereof is aligned with the axis of the rotation and the center line of the discharge port and the axis of the rotation are located in one plane or substantially in one plane, and by providing a turbomachine support member in the form of cylinder or disc concentrical with the axis of rotation over the entire or substantial circumference about the axis of rotation. The centrifugal turbomachine according to the invention offers advantages in that it is convenient to use, installing of the machine and arranging of pipes are facilitated and that cost is reduced due to standardization of the parts.

BRIEF DESCRIPTION OF THE DRAWINGS

FIG. 6 B is a sectional view taken along the line VI—VI of another embodiment;

FIG. 6 C is a fragmental enlarged view of FIG. 6 B; and

DESCRIPTION OF THE PREFERRED EMBODIMENTS

Figure 1:
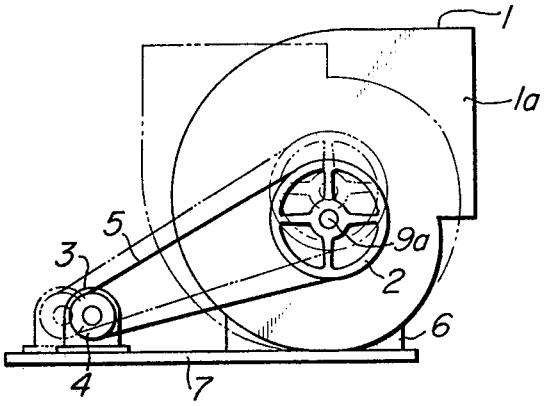
FIG. 1 PRIOR ART
FIG. 1 is a front view (as seen from a side opposite to the suction side) of a centrifugal turbomachine of the prior art, shown in operation.

Referring FIG. 1, there is shown a centrifugal fan of the type which is driven by a belt from an electric motor. The centrifugal fan comprises a spiral casing 1 arranged in a manner to accommodate therein an impeller (not shown) of the fan and formed with a discharge port 1*a*. The reference numeral 2 designates a driven pulley mounted on a rotatable shaft (disposed normal to the plane of the figure) of the impeller. The numeral 3 designates an electric motor for driving the fan; 4 a drive pulley mounted on an output shaft of the electric motor 3; and 5 a belt trained around the driven and drive pulleys. The spiral casing 1 is provided with legs 6 for installation, and the fan and electric motor are installed on a common base 7. In FIG. 1, solid lines indicate the casing in a position in which the fluid is discharged horizontally, and broken lines indicate the casing in a position in which the fluid is discharged vertically upwardly. As seen from FIG. 1, the height of the axis 9*a* of rotation is varied depending on the discharge direction of fluid.

Figure 2:
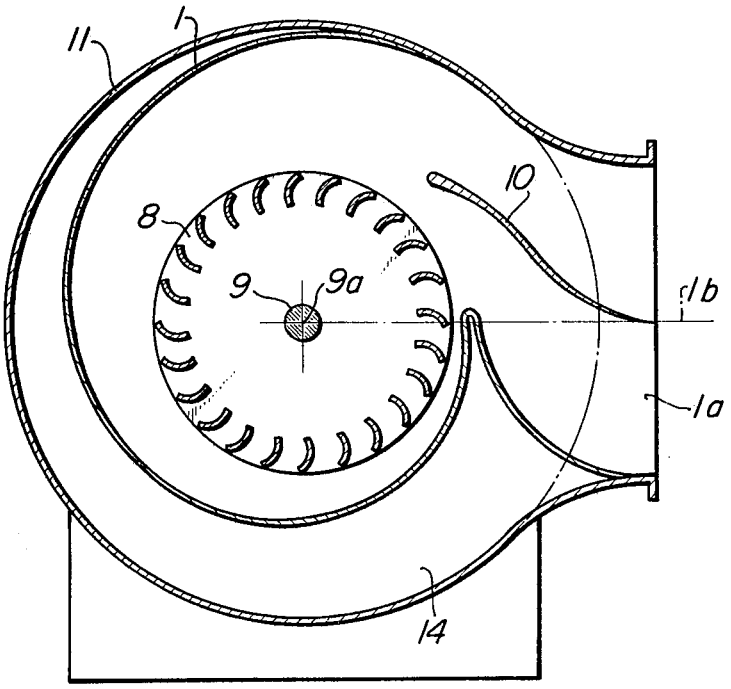
FIG. 2 is a sectional front view of the centrifugal turbomachine comprising one embodiment of the invention.
Figure 3:
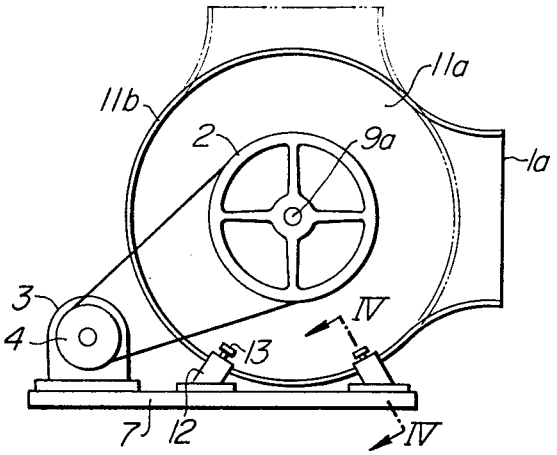
FIG. 3 is a front view (as seen from a side opposite to the suction side) of the centrifugal turbomachine shown in FIG. 2, shown in operation.
Figure 4:
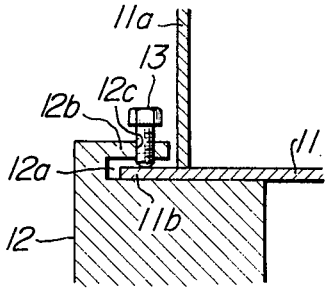
FIG. 4 is a sectional view on an enlarged scale, taken along the line IV—IV in FIG. 3.

FIGS. 2 to 4 show one embodiment of the invention. The reference numeral 8 designates an impeller mounted on a rotatable shaft 9. The fan shown is of a multiblade type. The reference numeral 1 designates a spiral casing which may be designed depending upon which type of impeller (backward curved, radial, etc.) is used. The discharge port 1*a* has a center line 1*b* which intersects the axis 9*a* of the rotatable shaft 9, and a suction port (not shown) has a center line which is aligned with the axis 9*a* of the rotatable shaft 9. In order to maintain a uniform discharged flow, a guide vane 10 may be provided in conformity with the principles of aerodynamics.

The reference numeral 11 designates an outer casing of which major portion constitutes a cylinder concentrical with the axis of the rotatable shaft 9 and which is connected at side portions thereof to the spiral casing 1 by means of casing side plates 11*a* (FIGS. 3 and 4). The outer casing 11 serves as support means for the turbomachine and has cylindrical rims 11*b* each extending outwardly from the casing side plates 11*a*. The reference numeral 12 designates a plurality of mounting blocks each fixed to a base 7 and having a recess 12*a*, a projection 12*b* and a threaded aperture 12*c* formed in the projection 12*b*. The fan can be mounted in place by inserting the cylindrical rims 11*b* in the recesses 12*b* of the mounting blocks 12 and tightening bolts 13 through the threaded apertures 12*c*.

The centrifugal turbomachine according to the invention is constructed as aforementioned. It will be appreciated that the discharge direction of fluid can be varied as desired within the range of about 180° and that the operation of changing the discharge direction of fluid can be performed readily. Thus changing the discharge direction of fluid does not lead to a change in the height of the axis of rotation and the height of the center line of the suction port. It is also in no way necessary to vary the position where the electric motor is to be installed, and the length of the belt. As the center line of the discharge port lies in the same plane as the axis of the rotatable shaft does, the height of the center line of the discharge port remains constant regardless of whether fluid is discharged horizontally rightward or horizontally leftward. Thus the height of the center line of the discharge port is determined only by the size of the outer casing. The contour of the fan is in the form of cylinder, so that the spiral casing can be designed freely to provide a desired shape so long as the spiral casing can be housed in the outer casing. This advantageously improves the aerodynamic performance of the fan, and at the same time makes it possible to standardize the parts for common use with fans of other types.

In the above-described embodiment of turbomachine according to the invention, the impeller is housed in a sort of doubly-constructed casing, so that the noise produced by the impeller and transmitted to outside is effectively reduced. An enclosed space 14 (See FIG. 2) defined between the spiral casing 1 and the outer casing 11 can be used as a sound absorbing material-packed housing. In case the space is packed with such material, the sound absorbing effect exhibits itself markedly. With such arrangement, the outer casing 11 serves as an outer plate of the sound absorbing material-packed box and the spiral casing 1, is preferably made of a porous plate to serve as an inner plate of the box.

Figure 5:
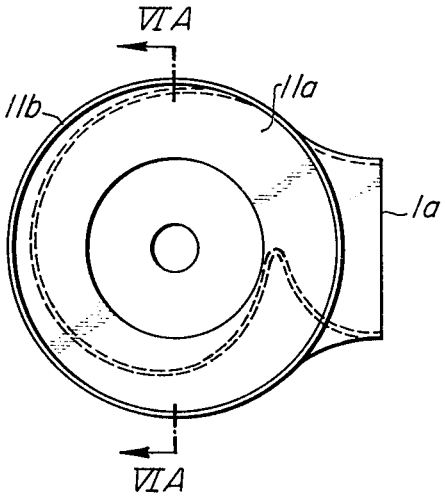
FIG. 5 is a front view of the centrifugal turbomachine comprising another embodiment of the invention.
Figure 6A:
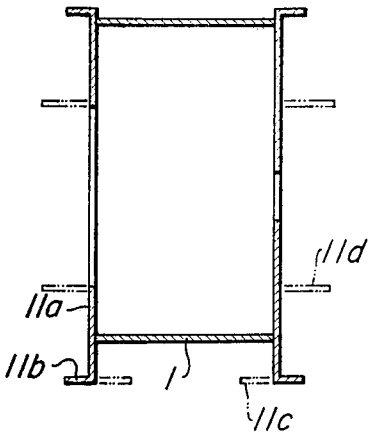
FIG. 6 A is a sectional view taken along the line VI—VI in FIG. 5.
Figure 6B:
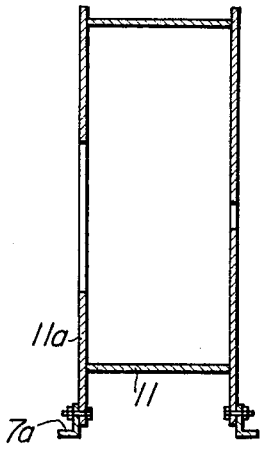
Figure 6C:
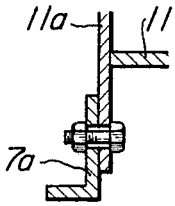

FIGS. 5 and 6 A show another embodiment of the invention in which any outer casing 11 is not provided and casing side plates 11*a* are provided at the outer sides thereof with cylindrical-shaped flanges 11*b* to serve as support means for the turbomachine. This embodiment is suitably applied to turbomachines of relatively small size and light weight to economize in materials.

FIGS. 6 B and 6 C show still another embodiment in which the casing side plates 11*a* are discs concentrical with the axis 9*a* of the rotatable shaft 9. In this embodiment, the casing side plates 11*a* serve as support means for the turbomachine. As shown in FIGS. 6 B and 6 C (which is a fragmentary enlarged view of FIG. 6 B), the turbomachine can be installed by securing the side plates 11*a* by bolts to mounting members 7*a* attached to the surface of the base 7. Alternatively, cylindrical flanges or support members may be provided inwardly from the casing side plates 11*a* (as indicated at 11*c* in FIG. 6 A), or attached to the outside of the casing side plates 11*a* (as indicated at 11*d* in FIG. 6 A). Such alternative arrangements are simple in construction and can achieve the same effect as the support means described in the previously described embodiments.

Figure 7:
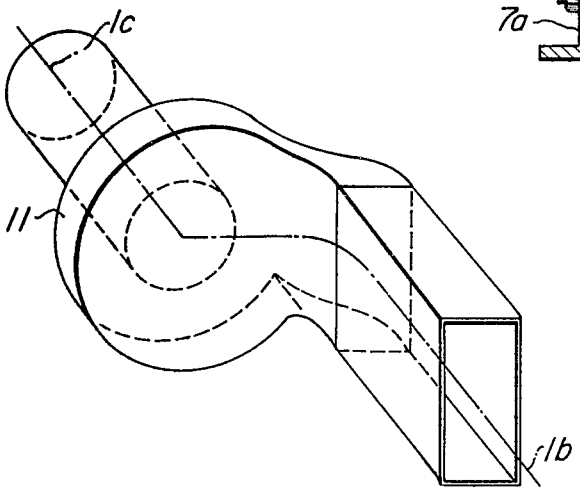
FIG. 7 is a schematic perspective view of the centrifugal turbomachine comprising still another embodiment of the invention.

FIG. 7 shows a further embodiment of the invention in which the center line 1*b* of the discharge port is bent at right angle to the radial direction of the impeller and extends in parallel to the center line 1*c* of the suction port with the center line 1*c* of the suction port and the center line 1*b* of the discharge port lying in one plane. This embodiment can achieve the same effect as the aforementioned embodiments and is additionally advantageous in use due to the fact that the suction pipe and the discharge pipe are parallel to each other.

From the foregoing description, it will be appreciated that the centrifugal turbomachine according to the invention provides the following advantages while the construction thereof is relatively simple.

(1) A variation in the discharge direction of fluid does not influence the height of the axis of the rotatable shaft and the center line of the suction port.

(2) The discharge direction of fluid can be varied as desired in a wide range.

(3) Since the center line of the discharge port lies in the same plane as the axis of the rotatable shaft does, the center line of the discharge port becomes radial about the axis of the rotatable shaft and the positional relationship among the suction port, axis of the rotatable shaft, discharge direction of fluid and center line of the discharge port is more simple than that of the prior art turbomachine.

(4) The height of the center line of the discharge port (in the case of horizontal discharge of fluid) is determined only by the size of the outer casing, and is not influenced by the sizes of the impeller and spiral casing.

The invention enables the parts of centrifugal turbomachines to be standardized, thereby reducing the number of types of casing, base, belt, etc. This results in a reduction in cost, and also makes it possible to achieve excellent results in laying down pipes and utilizing the available space in a room.

What is claimed is:

1. A centrifugal turbomachine comprising:

an impeller mounted on a rotatable shaft, a housing for said impeller in the form of a spiral casing having suction and discharge ports therein, said suction port having its center line aligned with the axis of said rotatable shaft, and the center line of said discharge port and the axis of said rotatable shaft lying substantially in a plane, a base for mounting said spiral casing thereon, an outer casing provided outside of said spiral casing and being in the form of a cylinder concentrical with the axis of said rotatable shaft over at least three-fourths of the circumference of said cylinder, a portion of said outer casing merging in an overlapping relation with a discharge port of said spiral casing and forming a unitary structure therewith, and an end portion of said outer casing extending to the outside of a side plate of said spiral casing, and mounting means secured to said base and including arcuate slots having a diameter equal to the outer diameter of said outer casing and having a central angle of arc smaller than 180°, the end portion of said outer casing being adjustably secured in said slots by fastening means whereby the discharge direction of fluid flow from said turbomachine may be adjusted by adjusting the position of said unitary structure relative to said base and mounting means.

* * * * *